United States Patent [19]

Tokuno et al.

[11] Patent Number: 4,466,320

[45] Date of Patent: Aug. 21, 1984

[54] ROTARY DIE CUTTER

[75] Inventors: Masateru Tokuno, Nishinomiya; Tetsuya Sawada, Kyoto, both of Japan

[73] Assignee: Rengo Co., Ltd., Osaka, Japan

[21] Appl. No.: 435,391

[22] Filed: Oct. 19, 1982

[30] Foreign Application Priority Data

Oct. 20, 1981 [JP] Japan ..... 56-169044

[51] Int. Cl.[3] ..... B23D 25/12; B26D 1/62

[52] U.S. Cl. ..... 83/325; 83/435.2

[58] Field of Search ..... 83/325, 435.2

[56] References Cited

U.S. PATENT DOCUMENTS

| | | | |
|---|---|---|---|
| 3,483,780 | 12/1969 | Hudson | 83/325 X |
| 3,765,286 | 10/1973 | Vossen | 83/325 X |
| 4,041,822 | 8/1977 | Gabel | 83/435.2 X |
| 4,420,998 | 12/1983 | Tokuno et al. | 83/325 X |

*Primary Examiner*—Donald R. Schran

*Attorney, Agent, or Firm*—Wenderoth, Lind & Ponack

[57] ABSTRACT

A rotary die cutter for die-cutting blanks one after another has a blank feed unit, a pair of cylinders for die-cutting the blanks, and an endless member running synchronized with the cylinders. The blanks are gripped by grippers mounted at equal spacings on the endless member. The cylinders are adapted to allow the grippers to pass between the cylinders while gripping the blanks.

3 Claims, 8 Drawing Figures

ROTARY DIE CUTTER

The present invention relates to a rotary die cutter used to die-cut blanks of corrugated fiberboard, similar type of paper, metal or plastic one after another into required shapes.

With a rotary die cutter for corrugated fiberboard, the blanks to be die-cut are piled up between a front guide and a rear guide and are fed one after another by means of a kicker coupled to a crank mechanism into between a pair of feed rolls, which feed them to the die cutter. It is required that the timing at which the blanks are fed to the die cutter is accurate to ensure die-cutting at correct positions.

In this arrangement, if the nip pressure between the feed rolls is too small, slip could occur between the rolls and the blank. But, even if the nip pressure is increased, slip cannot be necessarily avoided.

On the other hand, increasing the nip pressure too much to prevent slip of the blanks would deform the corrugations on the fiberboard, thus decreasing its strength. Thus, the problem of slip cannot be solved by increasing the nip pressure.

The higher the speed at which the blanks are fed, the more the extent of slip and the error in timing are. The use of blanks die-cut at incorrect position for the production of e.g. packing cases would result in defective products. Particularly if preprinted fiberboard is die-cut at incorrect positions, even a slight error in position would be conspicuous.

In the case of other types of blanks than corrugated fiberboard, too, slip at the feed rolls is a problem, though there is no problem of corrugations being deformed.

An object of the present invention is to provide a rotary die cutter which obviates such shortcomings.

In accordance with the present invention, before arriving at a pair of cylinders for die cutting the blanks, the leading end of each blank is gripped by grippers mounted at equal spacings on an endless member running synchronized with the cylinders, said cylinders being adapted to allow the grippers to pass between the cylinders.

Other objects and features of the present invention will become apparent from the following description taken with reference to the accompanying drawings, in which.

Figure 1:
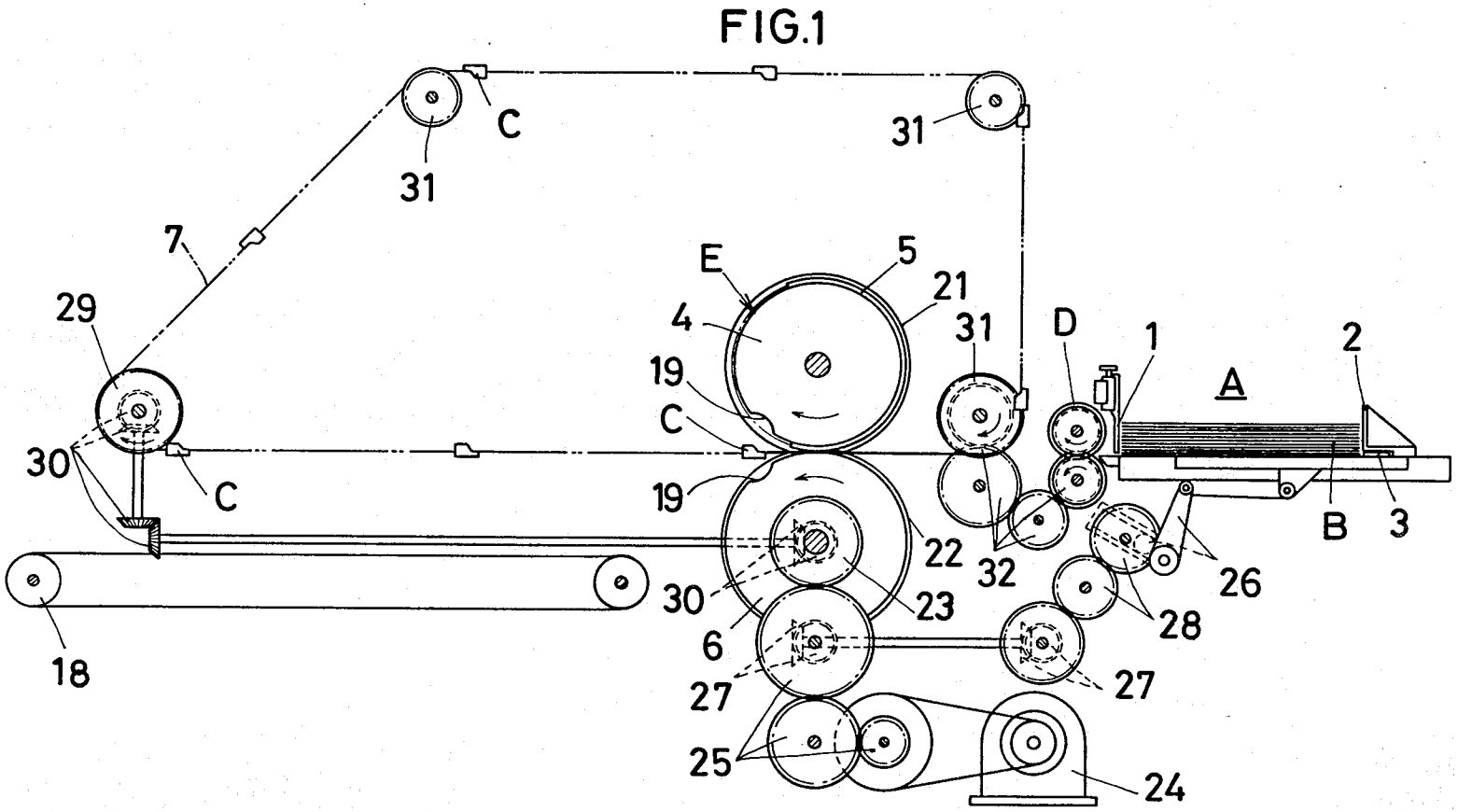
FIG. 1 is a side view of the rotary die cutter embodying the present invention.

Referring to the drawings, a blank supply unit A has a front guide 1 and a rear guide 2 between which blanks B are piled up, and a kicker 3 adapted to reciprocate to push the lowermost blank forward.

The blank supply unit may have a sucker for sucking the blanks one after another, instead of the kicker. Or, it may have both the kicker and the sucker.

A die cutting unit E, provided in front of the blank supply unit, has a cylinder 4 on the outer periphery of which a die 5 is mounted, and an anvil cylinder 6 rotating at the same speed as the cylinder 4. The blanks are die-cut when passed between these two cylinders 4, 6. The anvil cylinder 6 has an outer peripheral surface which may be soft enough to allow the die 5 to bite thereinto, or hard enough not to allow it to do so.

On either side of the die cutting unit E, there are provided a pair of endless members 7 adapted to run in the same direction as the blanks from the blank supply unit do, and synchronized with the cylinders 4 and 6.

A plurality of grippers C are mounted on and across the endless members 7 with equal spacings to grip the leading edge of the blank from the blank supply unit at least until it is engaged between the die 5 and the anvil cylinder 6. The spacings between the grippers C are substantially equal to the circumference of the cylinders 4 and 6.

Figure 2:
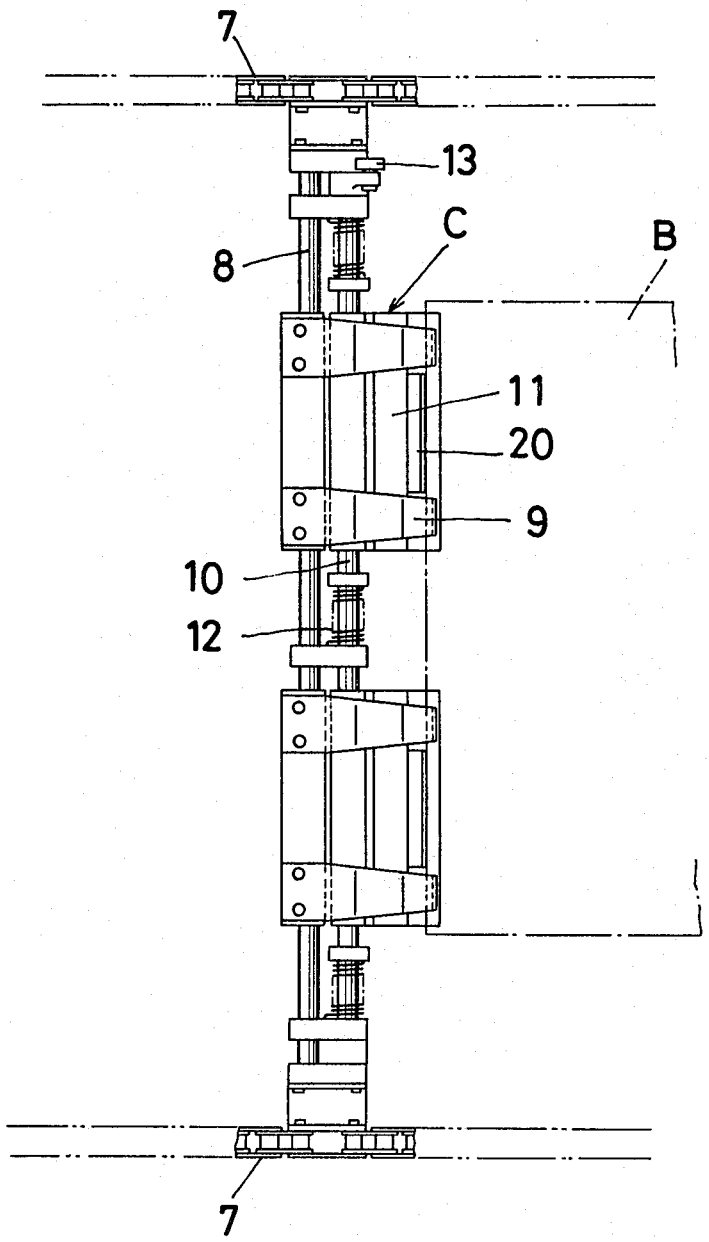
FIG. 2 is an enlarged plan view of the gripper used in this invention.

The gripper C comprises a bar 8 laterally extending across the endless members 7, fixed grip pieces 9 secured on the bar 8, movable grip pieces 11 fixedly mounted on a shaft 10 so as to be pivotable with the shaft toward and away from the fixed pieces, springs 12 which cause the movable grip pieces 11 to pivot toward the fixed pieces into their closed position, and cam rollers 13 integral with the shafts 10. (FIG. 2).

It will be described how the blanks are clamped by the grippers.

Figure 3:
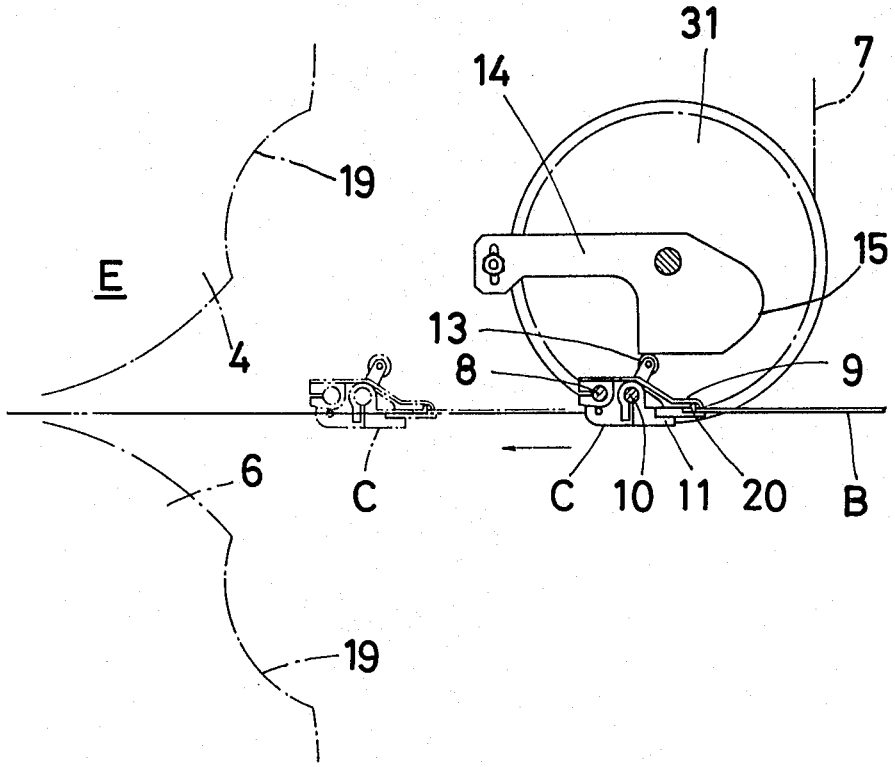
FIG. 3 is a side view showing how the blank is gripped before die-cutting.
Figure 4:
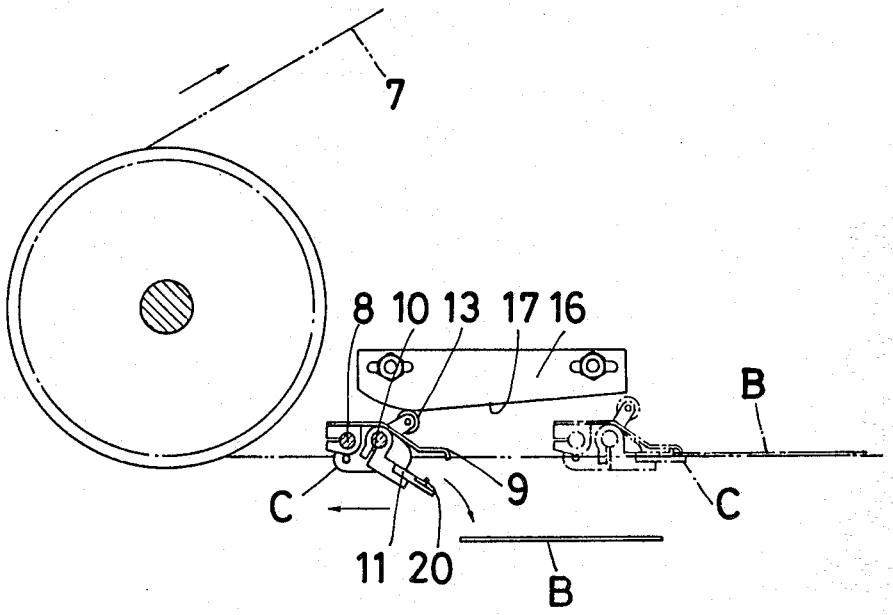
FIG. 4 is a side view showing how the blank is released after die-cutting.
Figure 5:
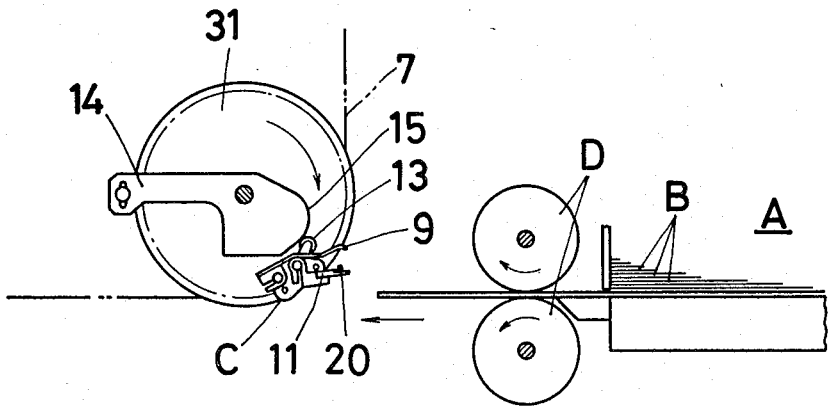
FIGS. 5–7 are side views showing how the blank is fed.
Figure 6:
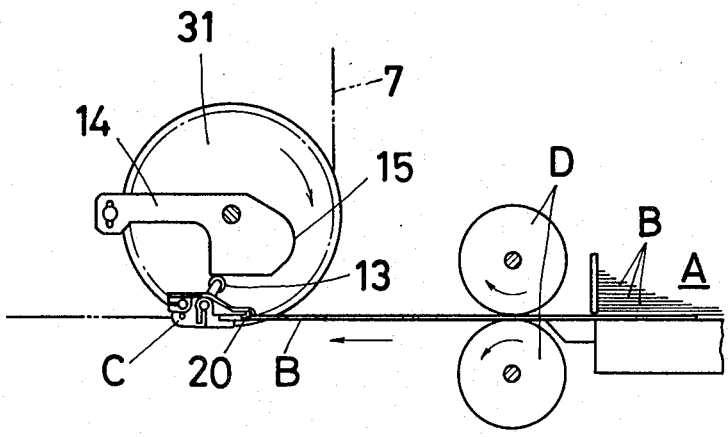
Figure 7:
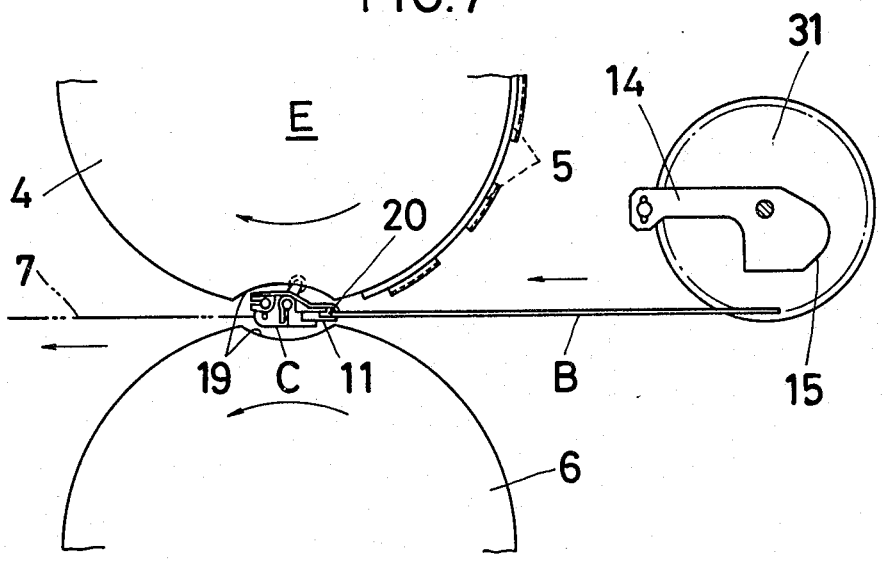
Figure 8:
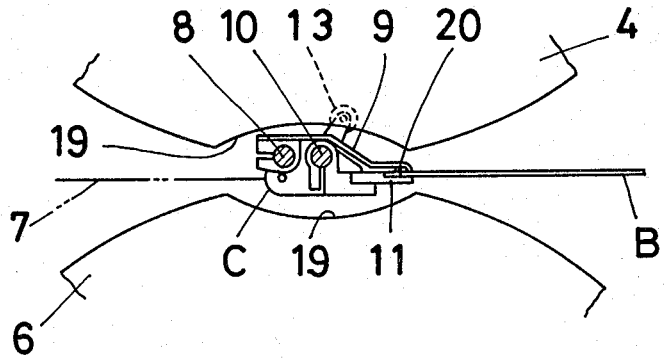
FIG. 8 is a side view showing how the gripper carrying the blank passes between the cylinders.

Referring to FIG. 3, on the shafts of guide sprockets 31 at the tail side of the endless members 7 are mounted cam plates 14 each having a curved surface 15. When the cam rollers 13 engage the curved surface 15 of the cam plates 14, the movable grip pieces 11 get away from the fixed grip pieces 9 and simultaneously the fixed grip pieces are pushed back by projections on the shafts 10. As a result, the pieces 9 and 11 are brought apart from each other and at the same time the leading edge of the blank is inserted between the grip pieces 9 and 11 which are now wide open.

When the cam rollers 13 are disengaged from the curved surface 15, the springs 12 bring the movable grip pieces 11 back to their closed position so that the blank will be gripped by the gripper C.

Next, it will be described how the gripper is opened.

Cam plates 16 each having a curved surface 17 are provided at the head side of the endless members 7. When the cam rollers 13 engage the curved surfaces 17, the movable grip pieces 11 are opened to their open position, so that the blank is let to fall on to a discharge unit 18.

The grippers C may be adapted to be opened some time after the leading edge of the blank has been nipped between the die 5 and the anvil cylinder 6, by adjusting the position of the cam plate 16.

It is to be understood that there is no intention to limit the construction and shape of the grippers to the ones shown in the preferred embodiment.

The cylinder 4 and/or anvil cylinder 6 are formed in their outer periphery with at least one recess 19 to allow the grippers to clear. The recess extends axially in the outer periphery of the cylider 4 and the anvil cylinder 6. Instead of such recesses, a soft member may be provided on the outer periphery of one or both of the cylinders 4 and 6. When the gripper passes between the cylinders 4, 6, the soft member is compressed to allow the gripper to pass the cylinders. Although in the embodiment the recesses are provided in both of the cylinders, they may be provided in one of them so long as the construction, shape and manner of mounting permit.

Although in the preferred embodiment the cylinders 4, 6 are formed with a single recess, they may be formed with a plurality of recesses and the spacings between the grippers may not be equal to the circumference of the cylinders 4, 6 so long as the arrangement is such that the grippers always meet the recesses if the endless member is driven in synchronization with the cylinders.

The movable grip pieces 11 are provided with a stopper 20 against which the leading edge of the blank is butted. Feed rolls D at front of the blank supply unit A are turned at a slightly higher speed than the speed of the endless members 7 to feed the blanks one after another into between the gripper pieces 9, 11.

With no feed rolls provided, the blanks may be supplied from the blank supply unit A so as to be fed timely into between the grip pieces.

The endless member 7 may be provided at only one side, not both sides, of the die cutting unit E, said endless member being provided with cantilever grippers C.

The cylinder 4 and the anvil cylinder 6 are provided at their end with gears 21, 22, respectively, which have the same number of teeth and mesh with each other. To a gear 23 coaxial with one gear 22, power is transmitted from a motor 24 through a set of gears 25. A crank 26 for reciprocating the kicker 3 is driven from the motor 24 through the gears 25, 27 and 28. A sprocket 29 for driving the endless member 7 is driven through the gear 23 and bevel gears 30. The feed rolls D are driven from a guide sprocket 31 for the endless member through gears 32.

By suitably determining the gear ratio between these gears, synchronization and timing control are possible between the blank feed unit A, die cutting unit E, grippers C, and feed rolls D.

In operation, the blanks fed one after another from the blank feed unit A are gripped on its leading edge by the grippers C which open for a short time and then close. After gripped, the blank is fed by the endless member 7.

When the grippers C arrive at the die cutting unit E, gripping the blank, the blank is die-cut by the die 5 on the cylinder 4. The grippers can pass the cylinders thanks to the recesses 19 without hitting them.

After die cutting, the grippers C are opened temporarily so that the blanks are let to drop.

It is to be understood that various changes or variations are possible within the scope of the present invention.

What are claimed are:

1. A rotary die cutter for die-cutting blanks one after another into desired shape, said rotary die cutter comprising:

a blank feed means for feeding the blanks one after another for die-cutting, a pair of cylinders for die-cutting the blanks when they pass therebetween, one cylinder having a die mounted thereon, an endless member running synchronized with said cylinders, a plurality of grippers mounted on said endless member at equal spacings for gripping the leading end of the blanks fed from said blank feed means, and at least one of said cylinders having means to allow said grippers to pass between said cylinders.

2. The rotary die cutter as claimed in claim 1 wherein at least one of said cylinders is formed with a recess in outer periphery thereof.

3. The rotary die cutter as claimed in claim 1 wherein at least one of said cylinders has a soft portion on outer periphery thereof.

* * * * *